US005249446A

United States Patent [19]

Biresaw et al.

[11] Patent Number: 5,249,446

[45] Date of Patent: Oct. 5, 1993

[54] PROCESS FOR MAKING AN ALUMINUM ALLOY FINSTOCK LUBRICATED BY A WATER-MICROEMULSIFIABLE COMPOSITION

[75] Inventors: Girma Biresaw, Lower Burrell; Dianne A. Zadnik, New Kensington, both of Pa.

[73] Assignee: Aluminum Company of America, Pittsburgh, Pa.

[21] Appl. No.: 732,754

[22] Filed: Jul. 19, 1991

[51] Int. Cl.[5] ..... B21D 22/00; B21D 28/00; B21B 45/02

[52] U.S. Cl. ..... 72/42; 252/33.4; 252/52 A; 29/890.03

[58] Field of Search ..... 72/41, 42, 43, 44, 45; 29/890.03, 527.2; 252/33.4, 52, 351, 353, 358

[56] References Cited

U.S. PATENT DOCUMENTS

| | | | |
|---|---|---|---|
| 2,833,717 | 5/1958 | Whitacre | 252/33.4 |
| 2,850,455 | 9/1958 | Kern | 252/33.4 |
| 2,878,185 | 3/1959 | Weamer | 252/33.4 |
| 2,927,079 | 3/1960 | Jense et al. | 252/33.4 |
| 2,994,123 | 8/1961 | Kritzer | 29/157.3 |
| 3,213,004 | 10/1965 | Blake et al. | 252/33.4 |
| 4,062,784 | 12/1977 | Baur | 72/42 |
| 4,228,217 | 10/1980 | Baur | 72/42 |
| 4,476,929 | 10/1984 | Stapp | 252/353 |
| 4,928,508 | 5/1990 | Courval | 72/42 |
| 4,956,110 | 9/1990 | Lenack et al. | 72/42 |
| 5,055,325 | 10/1991 | Trivett | 72/42 |

FOREIGN PATENT DOCUMENTS

| | | | |
|---|---|---|---|
| 0187494 | 11/1983 | Japan | 72/42 |

*Primary Examiner*—Lowell A. Larson
*Assistant Examiner*—Michael J. McKeon
*Attorney, Agent, or Firm*—Glenn E. Klepac

[57] ABSTRACT

Aluminum alloy finstock for making heat exchanger fins. The finstock is prelubricated with a water-microemulsifiable lubricant composition comprising an oil, an anionic surfactant, a polyalkoxy alkylphenol cosurfactant, and optionally a $C_{10}$–$C_{36}$ mono- or dicarboxylic acid. The lubricant composition is preferably applied to the finstock dissolved in hexane which is then evaporated, leaving a water-microemulsifiable lubricant residue. The lubricated product is readily washable with water to microemulsify the lubricant residue into a microemulsion.

19 Claims, No Drawings

PROCESS FOR MAKING AN ALUMINUM ALLOY FINSTOCK LUBRICATED BY A WATER-MICROEMULSIFIABLE COMPOSITION

PENDING RELATED APPLICATION

This application is related to copending U.S. patent application Ser. No. 732,924, filed Jul. 19, 1991, and entitled "Water-Microemulsifiable Lubricant for Aluminum Alloy Preforms".

FIELD OF THE INVENTION

The present invention relates to a water-microemulsifiable lubricant composition for aluminum alloy finstock and to a process for manufacturing heat exchanger fins from such lubricated finstock.

BACKGROUND OF THE INVENTION

Numerous compositions for lubricating aluminum alloy materials are known in the prior art. However, there is still a need for aluminum alloy finstock material which is prelubricated before use and which also has good lubricity, cleanability and wettability properties. The term "lubricity" means the ability of a lubricant to maintain its film strength after aging and also after coming into contact with water. "Cleanability" means the ability to easily remove the lubricant from the finstock surface, preferably by rinsing with water. "Wettability" means the ability to cause spreading of water droplets as measured by contact angle.

At the present time, most aluminum alloy finstock is lubricated with oil at the time of shaping in a fin press die. Consequently, the shaped fins must be degreased after being formed into fins. Degreasing requires usage of an organic solvent such as trichlorethylene, which itself poses hazards to the health and safety of workers, as well as increased handling and transportation costs in disposal to assure the avoidance of environmental pollution.

Proposals have been made to reduce the problems noted above by lubrication with a lubricating oil dissolved in a volatile solvent. After the finstock is shaped into fins, the solvent evaporates, leaving residual oil on surface portions of the fins. Such residual oil is difficult to remove other than with volatile solvents and, if left on the fins, provides a hydrophobic surface which interferes with efficient operation of the fins. The evaporated solvents may also cause unacceptable emission problems.

Several processes for producing hydrophilic coatings on aluminum alloy finstock are known in the prior art. Some references disclosing hydrophilic finstock coatings are Kaneko et al U.S. Pat. No. 4,421,789; Uchiyama et al U.S. Pat. No. 4,462,842; Imai et al U.S. Pat. No. 4,588,025; Kaneko et al U.S. Pat. No. 4,726,886; Sako et al U.S. Pat. Nos. 4,783,224 and 4,954,372; Mizoguchi et al U.S. Pat. No. 4,957,159; and Yamasoe U.S. Pat. No. 4,973,359. These finstock coatings perform satisfactorily in preventing accumulations of water droplets which might increase resistance to air flow adjacent the fins and thereby reduce heat exchange efficiency. However, it has been found that coated finstock also increases wear rates on forming dies which shape the finstock into heat exchanger fins. Attempts to reduce wear on the forming dies by lubrication with a conventional oil-base lubricant result in a need to degrease the shaped fins so that they may benefit from their hydrophilic coating. Accordingly, there is a need for a suitable lubricant composition which will reduce wear rates on the forming dies to satisfactory levels.

Courval U.S. Pat. No. 4,928,508 has proposed lubricating hydrophilic aluminum alloy finstock with a water-soluble lubricant coating that is dried before shipping and storage. The preferred water-soluble lubricant is an ethoxylated castor oil having some solubility in water. However, because of the limited solubility of ethoxylated castor oil in water, cleanability of fins made from the finstock may not be assured. In addition, the Courval lubricant composition is dissolved in isopropanol for application to the finstock. Health and safety concerns require specialized procedures and equipment in the use of isopropanol and other alcoholic solvents with consequent increased costs.

SUMMARY OF THE INVENTION

In accordance with the present invention, each of the above-identified problems is substantially overcome by means of a water-microemulsifiable lubricant composition. The term "water-microemulsifiable" used herein refers to the ability of the lubricant composition to form a water-in-oil or oil-in-water microemulsion when lubricated metal is washed with water. The type of microemulsion formed depends on whether the water becomes a dispersed or a continuous phase. A microemulsion is optically clear and thermodynamically stable. The surfactant and cosurfactant in the composition stabilize the oil or water droplets in the form of micelles having an average size of approximately 50–800 angstroms. In contrast, emulsions are thermodynamically unstable and have an average droplet size greater than about 0.1 micron (1,000 angstroms).

Applicants prefer a water-microemulsifiable lubricant composition which forms a water-in-oil microemulsion when washed with water because such composition is soluble in hydrocarbon solvents such as hexane and pentane which do not pose serious health risks when the composition is applied to metal. Water-microemulsifiable lubricant compositions in which water becomes the continuous phase require hydrophilic solvents such as isopropanol and acetone for their application to metal. Usage of those solvents entails specialized equipment and procedures due to safety and health concerns.

The lubricant composition is applied onto aluminum alloy finstock having a thickness of less than about 250 microns. The finstock preferably comprises an alloy of the 1000, 3000, or 7000 (Aluminum Association) series. Aluminum 1100-0 alloy finstock having a thickness of about 112 microns (4.4 mils) is used in one particularly preferred embodiment. The lubricant composition may be applied onto the metal by either dip coating, spraying or roll coating. Dip coating is particularly preferred.

The aluminum alloy finstock is formed into heat exchanger fins by progressively uncoiling the metal from a coil and then passing an uncoiled strip of the material through a set of finpress dies. One preferred method for making heat exchanger fins is set forth in Kritzer U.S. Pat. No. 2,994,123, issued Aug. 1, 1961, the disclosure of which is incorporated herein by reference. Efficient operation of Kritzer's finstock shaping method requires lubrication at an interface between exterior surfaces of a strip of the finstock material and the forming dies.

When heat exchanger fins made in accordance with the invention are washed with water, the lubricant residue is microemulsified away. The fins are left with clean and wettable surface portions.

DETAILED DESCRIPTION OF A PREFERRED EMBODIMENT

The water-microemulsifiable lubricant compositions of the invention comprise a water-insoluble oil, an anionic surfactant, and a polyalkoxy alkylphenol cosurfactant. The lubricant composition may also contain a $C_{10}$–$C_{36}$ mono- or dicarboxylic acid. Some preferred portions of ingredients are about 50–85 wt % oil, about 5–30 wt % anionic surfactant, and about 5–25 wt % cosurfactant. A more preferred composition comprises about 60–80 wt % oil, about 8–25 wt % anionic surfactant, about 7–17 wt % cosurfactant, and about 1–12 wt % of a $C_{12}$–$C_{20}$ carboxylic acid.

The water-insoluble oil may be natural or synthetic. Mineral oils and mixtures thereof are preferred. Particularly preferred are medium viscosity mineral oils having viscosities of about 25–100 CST (centistokes) at 40° C. Also preferred are mineral oil fractions of naphthenic base stocks because they microemulsify more readily than paraffinic base stocks. Some suitable synthetic oils include the normal paraffins, polyalphaolefins, diesters, and alkylbenzenes. Lower viscosity normal paraffins having viscosities of about 5–50 CST at 40° C. are the preferred synthetic oils.

The anionic surfactant generally comprises a water-soluble sulfate, sulfonate, or sulfosuccinate. The sulfate surfactants are monoesters of sulfuric acid and various aliphatic alcohols. Preferably, the alkyl group has from 10 to 100 carbon atoms in essentially linear arrangement. Another class of sulfates are monoesters of sulfuric acid and an ethoxylated alcohol. In this class, the alkyl group contains about 10–100 carbons and there are about 1–10 ethylene glycol units.

The sulfonate surfactant may be either an aliphatic or an alkyl substituted aromatic sulfonate. Aliphatic sulfonates comprise about 10–100 carbon atoms in essentially linear arrangement and a sulfonic acid ($SO_3H$) group. The acid group is preferably attached at or near the end of the carbon chain. The alkyl substituted aromatic sulfonates comprise a sulfonated benzene or naphthalene molecule having at least one alkyl group of about 1–30 carbon atoms attached to the aromatic ring. The sulfonate surfactants may be manufactured by sulfonation of aromatic components in various petroleum fractions obtained by refining crude oil.

The sulfosuccinate surfactant preferably comprises a diester of sulfosuccinic acid and a $C_4$–$C_{12}$ alcohol. A particularly preferred sulfosuccinate is dioctyl sodium sulfosuccinate, which is sold commercially under the trade name Aerosol OT.

In all of the above anionic surfactants, the useful salts are alkali metal salts, amine salts, and the ammonium salt. The amine salts are formed by reaction with low molecular weight amines such as morpholine, triethanolamine, and the like. Sodium salts are especially preferred.

The cosurfactant preferably comprises an alkoxylated alkylphenol wherein the hydrophobic portion of the molecule contains at least one alkyl group of about 2–50 carbons, more preferably about 6–12 carbons. There are also about 1–10 alkoxy groups, preferably about 2–10 ethoxy groups. A particularly preferred cosurfactant comprises nonyl phenol ethoxylated with about 4 ethoxy groups.

A preferred lubricant composition contains about 1–12 wt % of a $C_{12}$–$C_{20}$ carboxylic acid. A particularly preferred composition includes about 1–5 wt % isostearic acid.

The term "isostearic acid" as used herein is not restricted to its literal meaning of 16-methyl heptadecanoic acid, but rather is intended in its more common meaning, for mixtures of $C_{18}$ saturated fatty acids of the general formula $C_{17}H_{35}COOH$. These are mixtures of isomers, liquid at room temperature and primarily of the methyl-branched series, which are mutually soluble and virtually inseparable. While most of the branched chains contain a total of 18 carbon atoms, not necessarily all of the molecules contain exactly that number. The branch is primarily methyl but may also contain some ethyl, and the distribution is typically toward the center of the chain but is still fairly random. U.S. Pat. Nos. 2,664,429 and 2,812,342 disclose methods for production of isostearic acid. Isostearic acid suitable for use in practicing the invention is sold commercially under the trade name Emersol 875 isostearic acid. This acid has a saponification value of about 197–204 and an average molecular weight of about 284.

The microemulsifiable lubricant composition optionally may contain other useful lubricant additives, for example, corrosion inhibitors, bactericides, antioxidants, and antifoam agents. Such other additives generally comprise less than about 5 wt % of the composition, preferably less than about 2 wt %.

The microemulsifiable lubricant composition is dissolved in a hydrocarbon solvent to form a lubricant solution. A preferred solvent is hexane. Other suitable hydrocarbon solvents are pentane, cyclohexane, toluene, and heptane. Finstock is dipped into the solution and then dried at ambient temperature, leaving a lubricant residue. Total coating weight of the dried residue is about 3–30 mg/ft$^2$, preferably about 5–25 mg/ft$^2$ and more preferably about 10–20 mg/ft$^2$. The finstock is thereby coated with a generally continuous film of a water-microemulsifiable lubricant residue.

Some lubricant compositions were made up in accordance with the invention to test for viscosity, lubricity, cleanability, and wettability. Four exemplary compositions are shown in Table I.

TABLE I

Microemulsifiable Lubricant Compositions

| Ingredient | Composition (wt %) A | B | C | D |
|---|---|---|---|---|
| Dioctyl Sodium Sulfosuccinate (Surfactant) | 10.2 | 20.4 | 10.2 | 20.4 |
| Ethoxylated Nonyl Phenol (Cosurfactant) | 12.2 | 12.2 | 12.2 | 12.2 |
| Isostearic Acid | 2.8 | 2.8 | 2.8 | 2.8 |
| Synthetic Oil (Normal Paraffin) | 74.8 | 64.6 | 0.0 | 0.0 |
| Mineral Oil | 0.0 | 0.0 | 74.8 | 64.6 |
| TOTAL | 100.0 wt % | 100.0 wt % | 100.0 wt % | 100.0 wt % |
| Viscosity (CST), 40° C. | 4.79 | 6.91 | 30.4 | 44.4 |

The lubricant compositions of Table I were dissolved in hexane and coated onto a number, n, of 3004 aluminum alloy finstock specimens and then dried. Coefficients of friction on the finstock specimens were measured before and after aging at 121° C. (250° F.) for two hours. Coefficients of friction were also measured before and after cleaning, which involved immersing the lubricated specimens for 90 seconds in 4000 ml of stirred deionized water at room temperature. Each specimen was dried and then retested. Results of the aging and cleaning tests are shown in Table II.

TABLE II

Effects of Aging and Cleaning on Coefficients of Friction in Lubricated Specimens

| Coating Weight (mg/ft²) | Lubricant A | Lubricant B | Lubricant C | Lubricant D |
|---|---|---|---|---|
| | Average COF Before/After Aging (n = 2) | | | |
| 13 | — | .13/.18 | — | — |
| 15 | — | — | — | .13/.17 |
| 17 | .14/.18 | — | .12/.19 | — |
| | Average COF Before/After Cleaning (n = 2) | | | |
| 16 | — | .14/.19 | — | — |
| 17 | .15/.18 | — | — | — |
| 18 | — | — | .13/.12 | — |
| 24 | — | — | — | .13/.13 |
| | Average Cleanability, Wt % Lubricant Removed (n = 3) | | | |
| 21 | — | 95% | — | 88% |
| 26 | 66% | — | — | — |
| 27 | — | — | 32% | — |

The data in Table II show that compositions C and D containing high viscosity mineral oil have a slightly lower coefficient of friction and lower cleanability than formulations A and B, which contain low viscosity synthetic oil. These data also show that higher concentrations of surfactant (in compositions B and D) increase the cleanability of lubricated finstock without substantially affecting the coefficient of friction.

Lubricity, cleanability, and wettability of metal samples lubricated in accordance with the present invention were measured for lubricant Compositions B and D, described above. Composition B contained 64.6 wt % normal paraffin synthetic oil and had a viscosity of 6.91 CST at 40° C., whereas Composition D contained 64.6 wt % mineral oil and its viscosity was 44.0 CST at 40° C. Both compositions were tested on samples of 3004 aluminum alloy sheet having no hydrophilic coating and on 1100-0 aluminum specimens coated with 0.5 and 1.0 mg/in² of a commercially available hydrophilic polymers coating. The contact angle of deionized water on lubricated and unlubricated samples was measured with a Model 100-00 contact angle goniometer from Rame-Hart Inc. Results are shown in Table III.

TABLE III

Lubricity, Cleanability and Wettability of Lubricant Compositions on 3004 Bare Metal and 1100-0 Alloy With Hydrophilic Coating

| Lubricant Coating, mg/ft² | Lubricant B Metal 3004 Hydrophilic Coating Weight 0 | Lubricant B Metal 1100-0 Hydrophilic Coating Weight 0.5 mg/in² | Lubricant B Metal 1100-0 Hydrophilic Coating Weight 1.0 mg/in² | Lubricant D Metal 3004 Hydrophilic Coating Weight 0 | Lubricant D Metal 1100-0 Hydrophilic Coating Weight 0.5 mg/in² | Lubricant D Metal 1100-0 Hydrophilic Coating Weight 1.0 mg/in² |
|---|---|---|---|---|---|---|
| | | | Average COF Before/After Aging (n = 2) | | | |
| 0 | — | — | 0.21/0.27 | — | — | 0.21/0.27 |
| 12.5 | — | — | — | — | — | 0.16/0.14 |
| 13.0 | 0.13/0.18 | — | — | — | — | — |
| 14.4 | — | — | — | — | 0.25/0.13 | — |
| 14.9 | — | — | 0.15/0.14 | 0.12/0.19 | — | — |
| 16.3 | — | 0.24/0.13 | — | — | — | — |
| 18.8 | — | — | — | — | — | 0.16/0.12 |
| 21.2 | — | — | 0.15/0.14 | — | — | — |
| 21.6 | — | — | — | — | 0.22/0.13 | — |
| 24.0 | — | 0.26/0.13 | — | — | — | — |
| | | | Average COF Before/After Cleaning (n = 2) | | | |
| 16.2 | 0.14/0.19 | — | — | — | — | — |
| 20.0 | — | — | — | — | 0.23/0.25 | — |
| 21.0 | — | — | 0.15/0.32 | — | — | — |
| 23.8 | — | — | — | 0.13/0.13 | — | — |
| 25.0 | — | 0.25/0.92 | — | — | — | — |
| 26.0 | — | — | — | — | — | 0.13/0.28 |
| | | | Average Cleanability, % Lubricant Removed (n = 3) | | | |
| 16.0 | — | 84.9 | 73.6 | — | — | — |
| 20.9 | 95.4 | — | — | 88.0 | — | — |
| 24.0 | — | — | — | — | 96.5 | 92.9 |
| | | | Average Contact Angle (Degrees) (n = 5 for 3004; n = 11 for 1100-0) | | | |
| 0 | 44.6 ± 1.2 | — | 11.0 ± 2.2 | 44.6 ± 1.2 | — | 11.0 ± 2.2 |
| 16.8 | — | — | 14.1 ± 3.4 | — | — | — |
| 18.6 | — | — | — | 22.4 ± 1.6 | — | — |
| 21.6 | 12.7 ± 1.1 | — | — | — | — | — |
| 25.2 | — | — | — | — | — | 14.0 ± 3.6 |

The data in Table III show that Composition D (with mineral oil) was easier to clean from sheet having a hydrophilic coating than Composition B (with synthetic oil). This is the opposite of what was observed for bare sheet having no hydrophilic coating.

It was also observed that unlubricated sheets coated with 1.0 mg/in² of the hydrophilic polymeric substance had superior wettability compared with bare metal. Lubrication with Compositions B and D enhanced wettability substantially on the bare metal, with Composition B being more effective probably because of the lower viscosity of its synthetic base oil. Within experimental error, lubrication with both Compositions B and D did not change wettability of 1100-0 sheet having the 1.0 mg/in² hydrophilic coating.

While the invention has been described in terms of preferred embodiments, the claims appended hereto are intended to encompass all embodiments which fall within the spirit of the invention.

What is claimed is:

1. A process for making aluminum alloy heat exchanger fins comprising the steps of:

(a) applying a water-microemulsifiable lubricant composition dissolved in a liquid hydrocarbon solvent onto an aluminum alloy finstock having a thickness of less than about 250 microns, said liquid hydrocarbon solvent being selected from the group consisting of hexane, pentane, cyclohexane, toluene and heptane, said lubricant composition consisting essentially of a water-insoluble oil, a surfactant selected from the group consisting of a water-soluble sulfate, a water-soluble sulfonate, a water-soluble sulfosuccinate and an alkali metal, amine or ammonium salt of said sulfate, sulfonate or sulfosuccinate, and a cosurfactant, thereby to form finstock coated with a film of the lubricant composition, said lubricant composition being capable of forming a microemulsion when combined with water; and (b) shaping said finstock into aluminum alloy heat exchanger fins by passing said finstock through a forming die, said film lubricating an interface between said finstock and said forming die.

2. The process as claimed in claim 1 further comprising:

(c) washing said heat exchanger fins with water, thereby to microemulsify said lubricant composition into a water-in-oil microemulsion, said heat exchanger fins having clean and wettable surface portions.

3. The process as claimed in claim 2 further comprising:

(d) coating said finstock with a hydrophilic polymeric substance prior to step (a).

4. The process as claimed in claim 1 further comprising:

(c) evaporating said solvent before step (b), thereby to leave a film of water-microemulsifiable lubricant residue on said finstock.

5. The process as claimed in claim 4 wherein said solvent is hexane.

6. The process as claimed in claim 1 wherein said finstock comprises an alloy of the 1000, 3000, or 7000 (Aluminum Association) series.

7. The process as claimed in claim 1 wherein said lubricant composition further comprises a $C_{10}$–$C_{36}$ mono- or dicarboxylic acid.

8. The process as claimed in claim 1 wherein said surfactant comprises a water-soluble sulfate, sulfonate, or sulfosuccinate.

9. The process as claimed in claim 1 wherein said cosurfactant comprises a polyethoxylated alkylphenol.

10. The process as claimed in claim 1 wherein said cosurfactant comprises a $C_6$–$C_{12}$ alkylphenol ethoxylated with about 2–10 ethoxyl groups.

11. The process as claimed in claim 1 wherein said lubricant composition comprises about 50–85 wt % oil, about 5–30 wt % surfactant and about 5–25 wt % cosurfactant.

12. The process of claim 1 wherein said lubricant composition comprises about 60–80 wt % oil, about 8–25 wt % surfactant, and about 7–17 wt % cosurfactant.

13. The process as claimed in claim 12 wherein said lubricant composition further comprises about 1–12 wt % of a $C_{12}$–$C_{20}$ carboxylic acid.

14. A process for making aluminum alloy heat exchanger fins comprising the steps of:

(a) providing an aluminum alloy finstock having a thickness of less than about 250 microns;

(b) applying onto said finstock a lubricant composition dissolved in a liquid hydrocarbon solvent selected from the group consisting of hexane, pentane, cyclohexane, toluene and heptane, said lubricant composition consisting essentially of a water-insoluble oil, a surfactant comprising an alkali metal salt of a water-soluble sulfosuccinate, and a cosurfactant comprising an alkoxylated alkylphenol;

(c) evaporating said solvent thereby leaving a film of water-microemulsifiable lubricant on said finstock;

(d) shaping said finstock into heat exchanger fins by passing said finstock through a forming die, said film lubricating an interface between said finstock and said forming die; and (e) washing said heat exchanger fins with water, thereby to microemulsify said lubricant composition into a microemulsion.

15. The process in accordance with claim 14 wherein said solvent comprises hexane.

16. The process in accordance with claim 14 wherein said lubricant composition is water-free.

17. The process in accordance with claim 14 wherein said lubricant composition consists essentially of about 50–85 wt. % oil, about 5–30 wt. % surfactant and about 5–25 wt. % cosurfactant.

18. The process in accordance with claim 14 wherein said lubricant composition consists essentially of about 60–80 wt. % oil, about 8–25 wt. % surfactant, about 7–17 wt. % cosurfactant and about 1–12 wt. % of a $C_{10}$–$C_{36}$ carboxylic acid.

19. The process in accordance with claim 14 further comprising:

(f) coating said finstock with a hydrophilic polymeric substance prior to step (a).

* * * * *